US005375927A

United States Patent [19]

Hermsen et al.

[11] Patent Number: 5,375,927

[45] Date of Patent: Dec. 27, 1994

[54] REVERSING ORBITAL PLATFORM MIXER

[75] Inventors: Kenneth D. Hermsen, Dyersville; Michael S. Duvinski, Dubuque, both of Iowa

[73] Assignee: Barnstead/Thermolyne Corporation, Dubuque, Iowa

[21] Appl. No.: 69,619

[22] Filed: Jun. 1, 1993

[51] Int. Cl.[5] ..... B01F 11/00

[52] U.S. Cl. ..... 366/208; 366/237; 366/601

[58] Field of Search ..... 366/208, 209, 216, 237, 366/219, 217, 601; 364/400, 502

[56] References Cited

U.S. PATENT DOCUMENTS

| | | | |
|---|---|---|---|
| 2,976,792 | 3/1961 | Chambers | 366/208 |
| 4,061,315 | 12/1977 | Eitzen | 366/208 |
| 4,109,319 | 8/1978 | Brandt | 366/219 |
| 5,060,151 | 10/1991 | Mikyska | 366/601 |

OTHER PUBLICATIONS

Barnstead/Thermolyne, "Big Bill" Orbital Shaker Specifications.
Boekel Industries, Inc., Orbitron Rotator Model I and II Brochure (undated).
Corning, Pulse Motor Stirrer Brochure.
Denley, Orbital Shaker Model A500 MK II Brochure (undated).
Edmund Buhler, Modek KS Specifications (undated).
Fisher Scientific, Portable Shaers—Models G2 and R2 Specifications.
Gallenkamp, Orbital Shaker Specifications.
GFL Shakers Specifications (undated).
Hanna Instruments; Professional Magnetic Stirrer Specifications.
IRA-Works, IKA Small and Large Shakers; Analytical Mills Brochure (undated).
Open Air Orbital Shakers; Model 4626, Model 4628, Model 4645 Specifications.
Open Air Orbital Shakers; Bench Top Orbit Shakers Specifications (undated).
Luckham, R/100/TW Rotatest Orbital Shaker Catalogue (undated).
Denley (Luckham Division) 768 Timers/Time Switches; Cam Timer-Gear Assembly.
Innova, Portable Gyrotory Platform Shaker Specifications (undated).
Prolabo of Paris, Nouveaux agitateurs magnetiques "Rotamag" Specifications.
Precision, Orbital Shakers Specifications.
Stuart Scientific, Shakers and Rollers Specifications (undated).
Stovall Life Science Inc.; The Belly Dancer Specifications.
Techne, Laboratory Equipment Specifications (undated).
B. Braun Melsungen AG, TU-1 Specifications.
Variomag-U.S.A., Electronic Stirrers Specifications (undated).

*Primary Examiner*—Robert W. Jenkins
*Attorney, Agent, or Firm*—Wood, Herron & Evans

[57] ABSTRACT

An orbiting platform mixer having a reversing cycle of operation. In response to input signals defining set points for the platform velocity, the mixing cycle time and the reversing period, a control commands a reversing cycle of a rotation of the orbiting platform in one direction at the at the platform velocity for the rotation period. After a pause, the control commands a rotation of the orbiting platform in the opposite direction for the rotation period; and the above reversing cycle is repeated for a period of time equal to the mixing cycle time. The control permits the input signals to be changed at an accelerated rate in response to the continued single state, that is, pressed state, of a push-button.

29 Claims, 5 Drawing Sheets

REVERSING ORBITAL PLATFORM MIXER

BACKGROUND OF THE INVENTION

1. Field of the Invention

The present invention relates generally to the area of agitating and more particularly, to an orbiting platform liquid mixer having reversing orbiting stirring cycles.

2. Description of the Related Art

The mixing of liquids in a laboratory environment must be done in accordance with many different requirements. For example, the mixing of liquids of widely different viscosities may require a vigorous mixing. In contrast, the mixing of cell cultures may require a gentle but thorough mixing. To accommodate the varying needs, there are two basic types of liquid mixers. The first has a stationary base on which the fluid container rests. A stirring bar is inserted into the container, and the stirring bar is coupled by a magnetic field to a magnet located beneath the table. Rotating the magnets beneath the table rotates their coupling magnetic fields and causes a corresponding rotation of the stirrer bars in the liquid. The direction of rotation of the stirring bars may be reversed, and rotation of the stirring bars may be continuous or intermittent such that there is a stirring of the liquids by mixing the liquids with a vortex produced by the stirring bars. Alternatively, the stirring bar rotation may be reversed each half cycle thereby mixing the liquids without a vortex, that is, shaking the liquids, The cycle times for the stirring bar rotation and the rest period between intermittent stirring bar rotations are selectable.

Liquid mixers using magnetic stirring bars have several disadvantages. First, the presence of the stirring bar in the liquid reduces the volume available for the liquids and hence, reduces the yield. Second, the presence of the stirring bars in the liquid has the disadvantage of being a potential source of contamination. Further, the magnetic stirring bars are less effective at keeping cells in suspension; and the abrupt directional reversals of the stirring bars may damage cells in the liquids being mixed. Further, if the magnetic stirring bar hits a projection or other irregularity on the bottom of the container containing the fluids, the resulting stirrer motion is irregular and has the potential of breaking the magnetic coupling between the stirring bar and the rotating magnet. Further, there is always the disadvantage of breaking the magnetic coupling between the stirring bar and the rotating magnet beneath the table thereby interrupting the stirring operation and potentially damaging the liquids being mixed.

Another type of liquid mixer is one in which one or more liquid containers is mounted on a moving platform. Commercially available moving platform liquid mixers provide a wide range of unidirectional rotating or reciprocating motions and more complex shaking motions. Of particular interest is a moving platform mixer having a continuous unidirectional orbiting motion. For purposes of this disclosure, an orbiting motion refers to a continuous circular motion having a diameter in the range of approximately from 0.5 inch to 1 inch. Typically, orbiting platform liquid mixers are powered by an electric motor which is mechanically coupled to the platform to provide the orbiting motion. Alternatively, the motor may be coupled to the platform to provide a reciprocating motion which is mechanically produced from unidirectional motion of the motor. The orbiting or reciprocating motion may be continuous or intermittent. Further, the total mixing time, the platform speed and time period between intermittent operations is adjustable. However, none of the orbiting platform liquid mixers provide the reversing orbiting operating cycle of the present invention.

Prior mixing controls require the entry of a wide range of time and velocity parameters, for example, mixing time may be varied in one minute increments from a minimum value of one minute to a maximum value of 99 hours, 59 minutes. However, the input circuits on most devices do not contain a numeric keypad with which the specific set point times can be entered. The input circuits on those devices only have time-up or time-down keys which are selectively depressed to sequentially increase or decrease the time in one minute increments, So that the full range of the time and velocity parameters can be traversed in a reasonable period of time, the prior controls have the capability of sensing the continuous activation of the increase or decrease keys. Further, the controls will increase the time rate of change of the value of the selected parameter in proportion to the period of time that the key is activated. Usually, there is some maximum limit to the rate of change which is dependent on the ability of an operator to respond to the changing values. As the operator watches the value of the parameter change, the operator is preparing to release the key in response to a displayed value. Consequently, there is a significant probability that given that state of preparedness, one or more unintentional releases may occur. That probability increases if the operator is unfamiliar with the touch or feel of the keys. With an unintentional release, prior mixing controls have the disadvantage of always reseting the rate of change of the value of the parameter back to its slowest: rate of change. Consequently, unintentional releases of the key will result in a significantly longer time period to select the desired value of the parameter.

SUMMARY OF THE INVENTION

To overcome the disadvantages associated with the liquid mixers discussed above, the present invention provides an orbiting platform liquid mixer having reversing orbital cycles. The invention is especially suited for use in environments where a wide range of mixing cycles from gentle stirring to vigorous agitation is required.

According to the principles of the present invention and in accordance with the described embodiments, the reversing orbital platform mixer has a motorized bidirectional drive connected to the platform such that operation of the bidirectional drive in opposite directions will cause directionally opposite orbiting motions of the platform, A control connected to the bidirectional drive commands an operating sequence of the bidirectional drive to orbit the platform in a first angular direction, for example, a clockwise direction, for a predetermined period of time. The orbiting motion of the platform is decelerated and stopped for a predetermined pause period. Thereafter, the bidirectional drive orbits the platform in an opposite angular direction, for example, a counterclockwise direction, for a second predetermined period of time after which the orbiting motion of the platform is decelerated and stopped for a predetermined pause period. The above operating sequence of the bidirectional drive is repeated thereby iteratively orbiting the platform through reversing rotational cycles over the desired mixing cycle time.

Input circuits provide input signals for selecting an orbiting velocity, a mixing cycle time and a reversing period, that is, the time the orbiting platform will rotate in one direction or the other. Other input switches are used singularly or in combination to select an angular direction of the orbiting motion or a reversing orbiting cycle of operation. A signal processing circuit is responsive to stored set points corresponding to the input signals to provide first direction and velocity output signals to a motor control circuit connected to the bidirectional drive. The first direction and velocity output signals operate the bidirectional drive during a selected reversing period to orbit the platform in a first rotational direction at a first angular velocity. A second velocity output signal is produced to decelerate platform to a second angular velocity, after which the orbiting platform is stopped. After a predetermined pause period of time, the signal processing circuit produces second direction and third velocity output signals to operate the bidirectional drive for a selected reversing period, thereby producing an orbiting motion of the platform at a third angular velocity in the opposite angular direction. A fourth velocity output signal decelerates the platform to a fourth angular velocity after which the orbiting platform is stopped. The signal processing circuit repeatedly provides the above sequence of direction and velocity output signals to iteratively execute the above reversing cycle of operation for a period of time equal to the desired mixing cycle time.

The input circuits of the present invention permit a release of the keys being used to increase or decrease a selected parameter for a short predetermined period of time without losing the accelerated rate of change of the value of the parameter. For example, if the key is released for less than 0.5 seconds, the control will maintain the current accelerated rate of change of the value of the parameter. Consequently, if there is a release of the key, but it is again depressed in less than 0.5 seconds, the operator will see no change in how the value of the selected parameter is changing. However, if the key remains released for a longer period of time and then is again activated, the control will reset the accelerated rate of change of the value of the selected parameter to the initial, or slowest rate of change, The present invention has the advantage of providing reversing orbital cycles of operation for an orbiting platform mixer that are selectively gentle or violent depending on the time periods and velocities selected. The mixer provides a better mixing of viscous nonmeniscable liquids and has the further advantage of stirring liquids without the potential for contamination. Further, the input circuits have an advantage of permitting keys, or push-buttons, activating a change in the value of a selected time or velocity parameter to be intermittently depressed without losing the accelerated rate of change of the parameter.

These and other objects and advantages of the present invention will become more readily apparent during the following detailed description in conjunction with the drawings herein.

BRIEF DESCRIPTION OF THE INVENTION

Figure 1:
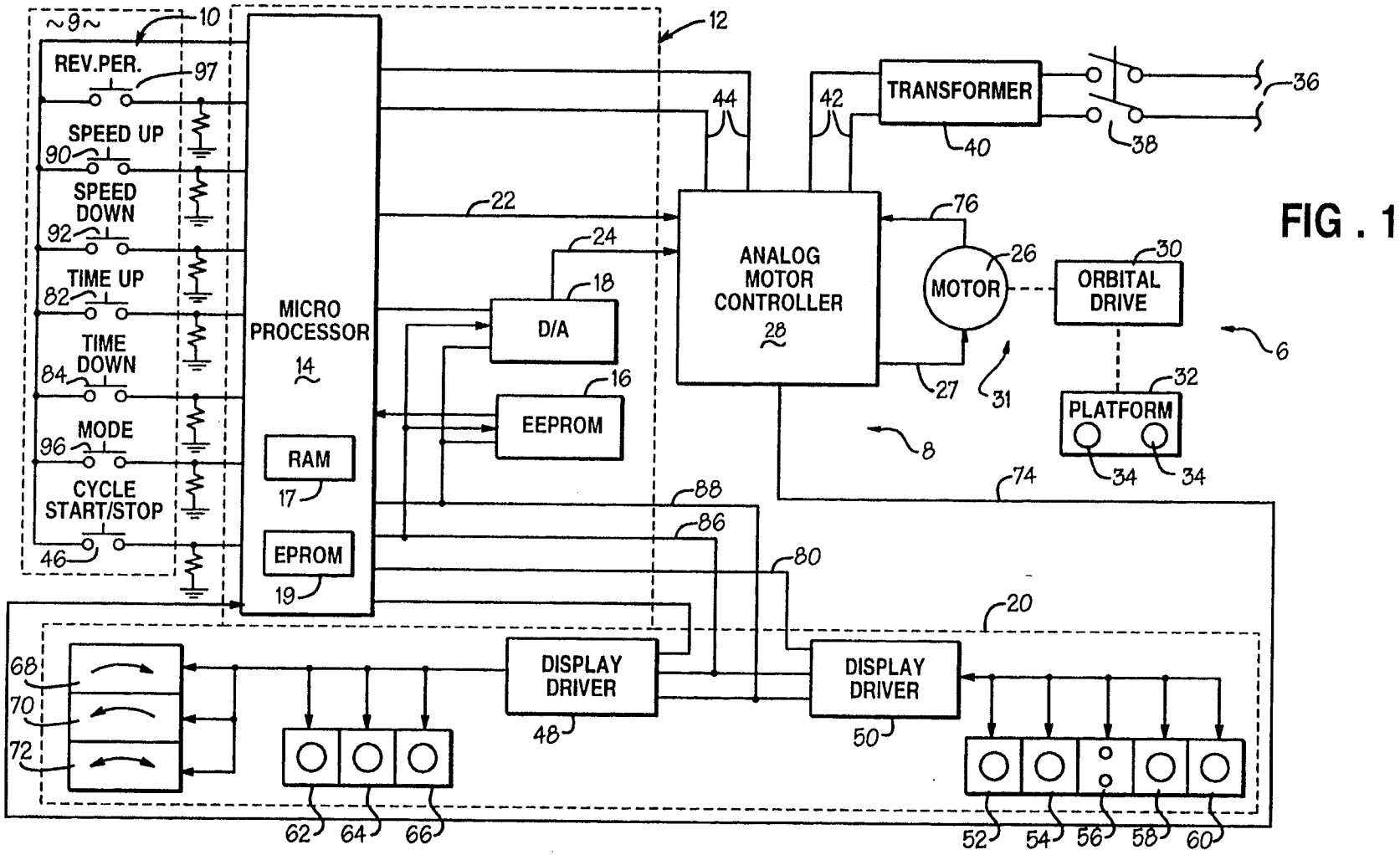
FIG. 1 is a schematic block diagram of the reversing orbital mixer and its control.

FIG. I is a schematic block diagram of the reversing orbital mixer 6 and its control 8. Prior to initiating a mixing cycle, an input circuit 9 comprised of input switches 10 located on an operator's panel (not shown) are used to produce input signals to establish set points for the mixing cycle time, the time of the reversing period, or reversing time, and the orbiting velocity of the platform. Those input signals are received by a signal processing circuit 12 comprised of a microprocessor 14, EEPROM 16 and a digital to analog ("D/A") converter 18. The microprocessor 14 includes a RAM 17 which stores all the time and velocity parameters and keeps track of all counters and count values used in the control. The RAM is a volatile memory, and those values are lost when power is removed from the control. Therefore, the EEPROM 16 is used to store the reversing period set point value and velocity set point value which are used in a subsequent power-up of the control. The microprocessor 14 also includes a EPROM 19 which is used to store operating programs and routines executed by the control 8. A display circuit 20 is responsive to the signal processing circuit 12 for displaying the platform velocity set point, the mixing cycle time set point, the reversing period set point, actual platform velocity, and remaining mixing cycle time. The signal processing circuit 12 produces a direction output signal on line 22 representing the desired direction of rotation of the motor 26 and an analog velocity output signal on line 24 representing the desired velocity of the motor 26. An analog motor controller 28 is responsive to the direction and the velocity output signals to produce a series of motor drive signals on lines 27 which are effective to rotate the motor 26 at the desired velocity and in the desired direction. Motor 26 is mechanically coupled to an orbital drive 30 the combination of which provides a bidirectional drive 31 that is mechanically coupled to the platform 32. Therefore, rotation of the motor 26 in one direction will be translated by the orbital drive 30 into an orbital motion of the platform 32. Typically, the orbital drive will cause the platform to move in a circular path having a diameter of one inch. One or more containers of liquid 34 are mounted on the platform 32, and the orbital motion of the platform is effective to mix liquids within the containers.

Power is supplied from a line 36 to an on/off switch 38. The on/off switch 38 is connected to a transformer 40 which provides the proper power signal level on power lines 42 to the analog motor controller 28. Power is supplied to the signal processing circuit 12 by power lines 44 connected to the analog motor controller 28. Once power is applied to the devices, the velocity and time parameters for a mixing cycle may be provided by the input switches 10; and a mixing cycle initiated. During the execution of a mixing cycle, the input devices 10 are effective at any time to change any previously stored set point. The operation of the orbiting platform mixer of FIG. I is controlled by several operating programs stored in PROM 19 and executed by microprocessor 14.

Figure 2:
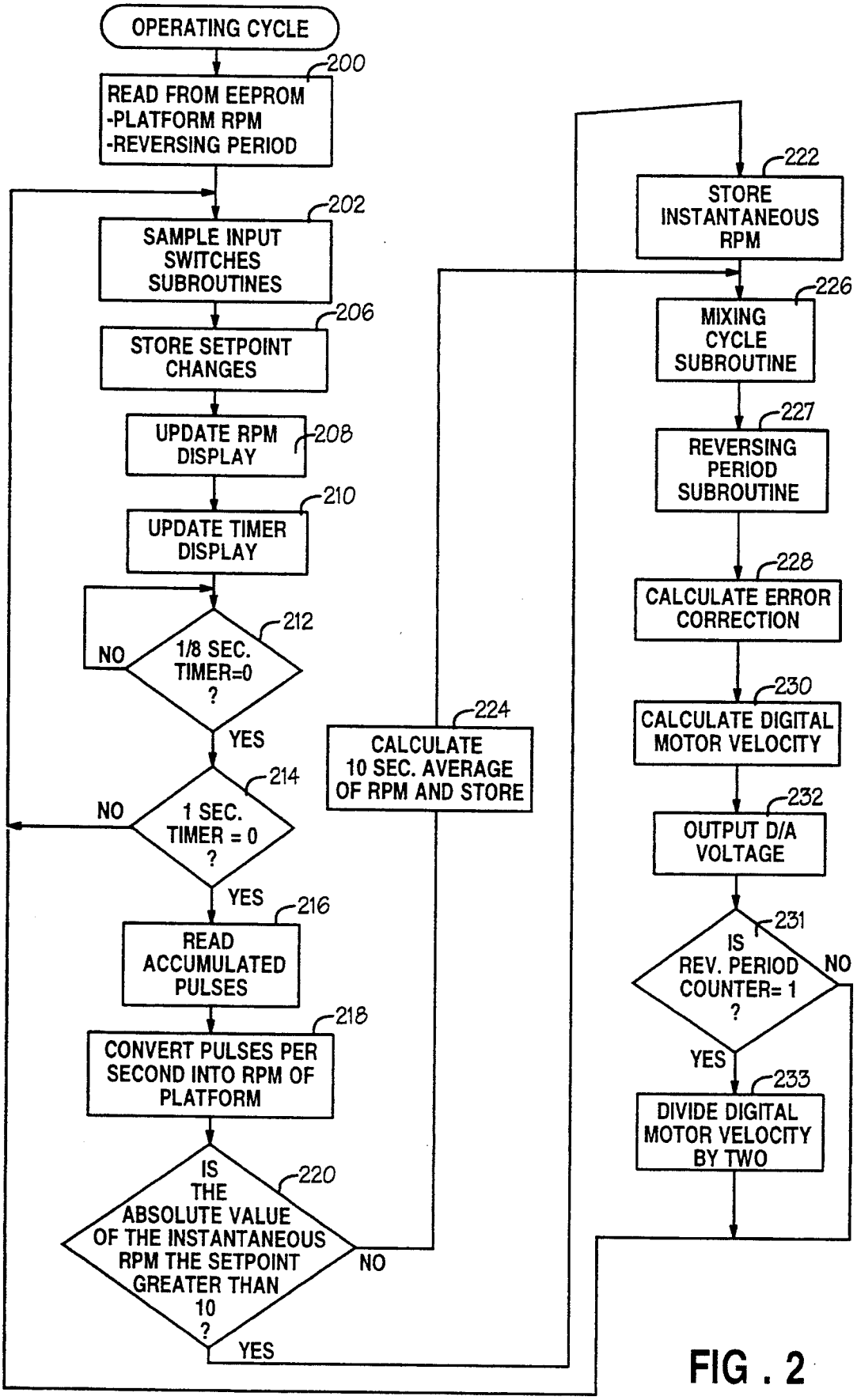
FIG. 2 is a flowchart illustrating the overall cycle of operation of the control of the reversing orbital mixer.

FIG. 2 is a flowchart illustrating the details of a program executed by the microprocessor 14 which defines the overall cycle of operation of the orbiting platform mixer. Application of power to the microprocessor 14 initiates the execution of the operating program of FIG. 2, and the program runs continuously until power is removed. Referring to FIGS. 1 and 2, at step 200, the microprocessor 14 reads the current values from the EEPROM 16 for the platform velocity set point, and the reversing period set point. Consequently, if the cycle start push-button 46 is depressed, the microprocessor 14 will initiate a liquid mixing cycle based on those currently stored set points. The microprocessor 14 has two basic functions. First, it must be constantly responsive to any change of state of the input switches 10, for example, the depression of one of the push-buttons on the operator control panel. Next, in response to any changes of state from the input switches, the microprocessor must produce output signals to execute a liquid mixing cycle consistent with the most current input signals. In order to stay constantly apprised of the states of the input switches, the microprocessor 14 services, that is, scans or samples, the states of the input switches 10 every 0.125 second. The microprocessor services the motor 26 that is, produces new output signals to the analog motor controller 28, once every second; and the microprocessor 14 updates the display circuits 20 every 0.125 second.

At step 202, the microprocessor executes various subroutines associated with each of the input switches to sample, that is, scan and read, the states of the input switches 10. For example, if the cycle start push-button 46 is depressed, an input switch subroutine for the cycle start push-button 46 will detect that state of the switch 46; and the microprocessor will initiate the operation of the motor 26 to execute, for example, a reversing cycle of operation, at the appropriate time in the operating cycle routine of FIG. 2. At process step 206, the microprocessor 14 reads the changes to the set point values into the appropriate storage locations in the RAM 17. The RAM 17 contains a number of storage locations which are sufficient to store the parameters necessary to execute a mixing cycle. Simultaneously with storing each new set point state, the microprocessor 14 also provides the new set point value to the display drivers 48 and 50 within the display circuit 20.

The display circuit 20 provides a plurality of LED displays 52–66 located on an operator panel (not shown) which display the set point values to the operator. For example, display driver 15 is connected to LED displays 52, 54, 56, 58 and 60 which normally display the unexpired mixing cycle time. Alternatively, LED displays 52–60 may be used to display the mixing cycle time set point. The mixing cycle is selectively variable in one minute increments from 0 minutes to 99 hours, 59 minutes. The LED displays 52 and 54 display hours, and the LED displays 58 and 60 display minutes. The LED displays 54–60 may also be selectively used to display the reversing period set-point in seconds, The reversing period may be selectively varied in one second increments from 5 seconds to 9999 seconds. The mixing cycle time is displayed in hours:minutes and the reversing period is displayed in seconds so that the operator can readily distinguish between the mixing cycle and reversing period set-point times being displayed.

Similarly, the display driver 48 is connected to LED displays 62, 64 and 66 which display either the current velocity of the platform or the current value of the velocity set-point representing the desired angular velocity of the platform. The orbital angular velocity of the platform is selectively variable in increments of 1 rpm from 10 rpm to 500 rpm. The LED displays 62–66 display a decimal point when displaying the velocity set-point but display the current platform velocity without a decimal point so that the operator can distinguish between the displays. The mixer 6 of the present invention selectively orbits the platform in either the clockwise direction, the counterclockwise direction or in a reversing cycle of operation in which the platform orbits in both the clockwise and counterclockwise directions. The LED displays 68, 70 and 72 are effective to display to the operator which of the respective clockwise, counterclockwise or reversing cycle operating modes is active.

After the input switches have been serviced, at process step 212, the microprocessor determines whether 0.125 second has passed. If not, the microprocessor 14 does nothing until it detects that 0.125 second has elapsed. At that point, the microprocessor then checks at process step 214 whether one second has elapsed. If not, the process returns to process step 202, and the output states of the input switches 10 are again sampled. Process steps 202–214 are iterated every 0.125 second. If process step 214 determines that one second has elapsed, the microprocessor 14 then services the motor control.

At step 216, the microprocessor 14 reads the value of the number of pulses it has received on line 74 from the analog motor controller 28. A typical brushless DC motor has three Hall effect sensors (not shown) producing position signals which change state in response to the armature rotation. Those armature position signals are received by the analog motor controller 28 on lines 76. The analog motor controller 28 produces a serial train of pulses wherein each pulse is created by a change of state of an armature position signal on lines 76 and represents an incremental change in the angular position of the armature. Therefore, the serial train of pulses is a composite of the changes of state of the armature position signals on lines 76 and may be used as a feedback signal from the motor 26 which is directly correlated to changes in the angular positions of the armature. Each time a pulse is output on line 74, the microprocessor 14 adds that pulse to an accumulator which stores an accumulation of the pulses over time. After each second as determined at step 214, the microprocessor 14 reads the number of pulses stored in that accumulator. The number of pulses in the accumulator is equivalent to the total change of angular position of the armature over one second, that is, over an increment of time; and therefore, the number of pulses in the accumulator dimensionally represents the angular velocity of the motor. The accumulator is set to zero after each second at process step 216.

The ratio of the mechanical coupling of the platform 32 to the motor 26 is a known design parameter. For example, the orbital drive 30 may require three revolutions of the motor 26 to produce one orbital revolution of the platform 32. Knowing that mechanical ratio, the microprocessor 14 converts, at process step 218, the pulses per second representing measured instantaneous motor velocity into a value representing the measured instantaneous velocity of the platform 32. Next, at process step 220, the microprocessor 14 subtracts the measured instantaneous velocity of the platform from the platform velocity set point. If the difference is greater than 10, the value of the instantaneous platform velocity calculated at process step 218 is stored in RAM 17 at process step 222. That stored value is the value used at process step 208 to update the velocity display.

The number in the accumulator of microprocessor 14, is a whole integer representing pulses per second or a frequency correlated to the instantaneous motor velocity. For smaller velocities, that is, smaller accumulator values, each change of a whole integer represents a change in motor velocity which is large relative to the absolute value of the velocity. Therefore, for the lower motor velocities, the integer values in the accumulator are averaged over a period of time. Taking an average provides values between those values which is equivalent to an interpolation between the whole integer values. Therefore, the velocity changes at the lower velocities will be less severe or slower which provides for better control and smoother motor operation. If process step 220 detects that the difference between the instantaneous velocity and the velocity set point is equal to or less than 10, at process step 224, the average of the instantaneous platform velocity over the last ten seconds is calculated and stored in the RAM 17.

Thereafter, at process step 226, the operating routine executes a mixing cycle subroutine which is effective to countdown the mixing cycle set point time and stop the motor 26 at the end of the mixing cycle. Thereafter, the operating routine executes a reversing period subroutine at process step 227. When the reversing cycle is chosen, the reversing period subroutine is effective to start the motor in a first direction, countdown the reversing period time, decelerate and stop the motor and reverse its direction so that the motor will run in the opposite direction during the next execution of the reversing period subroutine.

The operating system routine at process step 228 executes a calculate error correction subroutine. Theoretically, all mechanical and electrical systems which are manufactured identically should respond identically to similar inputs. In reality, the response of systems may vary in real time, and their operations are not precisely identical. Further, control strategies may assume a linear system which in reality may be a nonlinear response. For example, the microprocessor 14 calculates a digital velocity signal which is input to the D/A converter 18 based on a linear relationship with the velocity set point of the orbiting platform. However, there will be some nonlinearity between the digital velocity signal and the velocity of the orbiting platform. That nonlinearity may vary over the full range of the velocity set point and may vary with temperature or other operating conditions. Therefore, the process at step 228 compares the velocity set point to an average of the orbiting platform velocity as determined from the measured motor velocity by the feedback pulses on line 74. If the algebraic difference between the velocity set point and the orbiting platform velocity is less than a predetermined magnitude, for example, four rpm, an error correction of a predetermined velocity, for example, ±0.5 rpm, is stored. The sign of the error correction is assigned to reduce the difference. If the difference is greater than the predetermined magnitude, a larger error correction, for example, ±3 rpm is stored. So that the system is able to stabilize in response to new velocity set point value, several iterations through the operating system routine are executed, for example, four, before an error correction is applied to the new velocity set point value.

The microprocessor 14, at process step 230, calculates a digital velocity signal which is an input to the D/A converter 18. The control assumes a linear relationship between the digital velocity signal commanding the velocity of the motor 26 and the velocity set point representing the velocity of the platform 32. The motor velocity and the platform velocity are related by the ratio of the mechanical coupling of the orbit drive 30 between the motor 26 and orbital platform 32. The calculation of the motor velocity signal also requires the algebraic addition of the stored error correction, if any, determined at process step 228. At process step 231, the operating system routine determines whether the reversing period counter is equal to one. If not, at process step 232, the D/A converter 14 produces an analog velocity output signal on output line 24. The analog velocity output signal is an analog equivalent of the digital velocity signal calculated by the microprocessor 14 at process step 230. Typically, the analog velocity output signal has a voltage range, for example, 0 volts to 2.5 volts which corresponds to the velocity set point range of 10 rpm to 500 rpm. The analog motor controller 28 is responsive to the analog velocity output signal to produce switching signals to operate the motor 26 at the desired set point velocity. It should be noted that the analog motor controller 28 contains resistance capacitance networks which control the time rate of change of the velocity signals being processed by the analog motor controller 28 thereby providing acceleration control.

Figure 3:
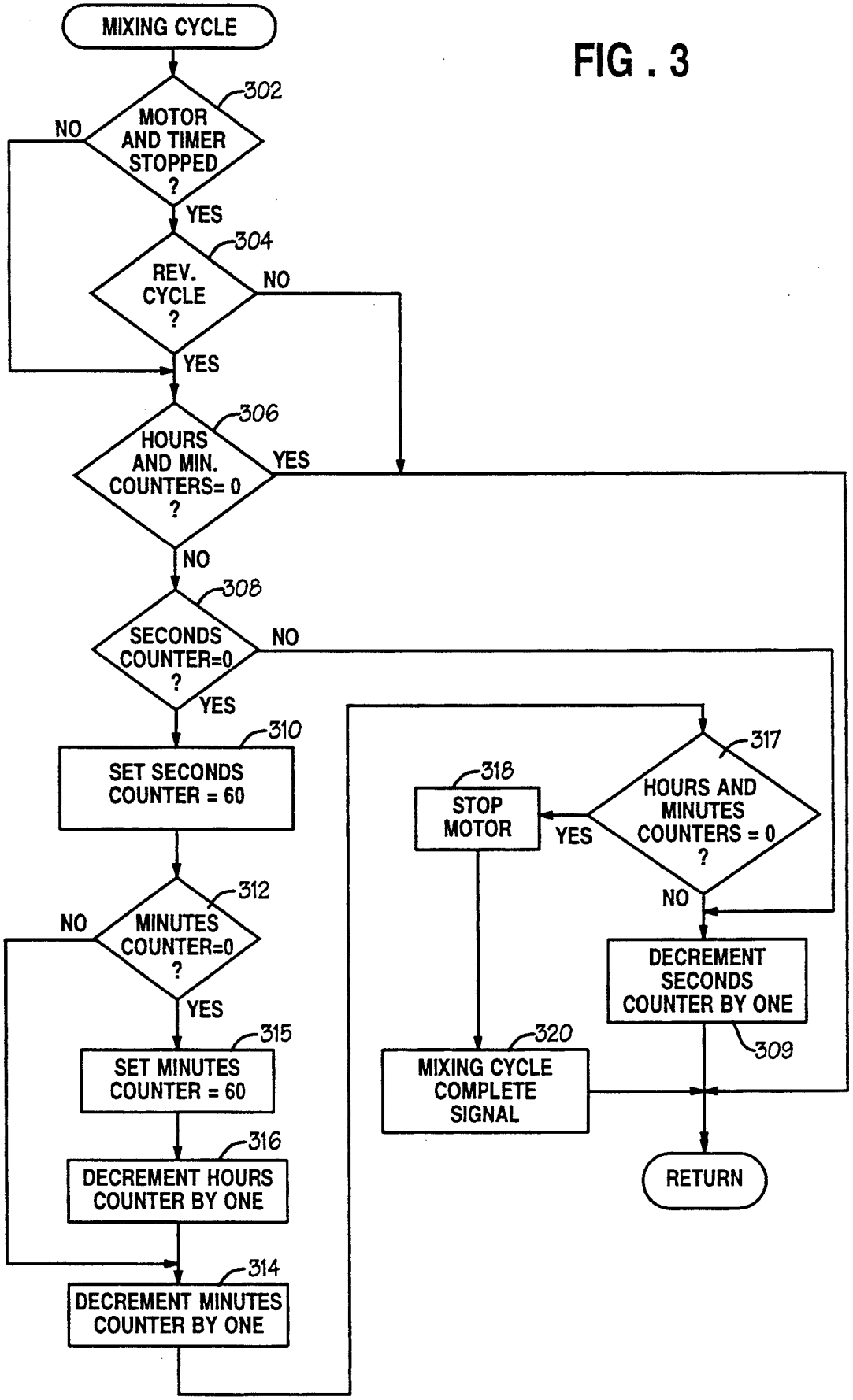
FIG. 3 is a flowchart illustrating the details of the mixing cycle subroutine and the production of motor control signals.

FIG. 3 is a flowchart illustrating the details of the mixing time subroutine executed at process step 226 of FIG. 2. The mixing time subroutine is executed every second with each pass through the basic operating system program of FIG. 2. Therefore, the mixing time subroutine 226 of FIG. 2 must first determine whether there is an active mixing cycle. First, at process step 302, the subroutine determines whether the motor 26 and the other timing subroutines are stopped. If the motor and other timing subroutines are stopped, the process at step 304 determines whether the reversing cycle has been selected. If not, and the motor is stopped, there is no active timing period, the mixing time subroutine of FIG. 3 is exited. If the motor is not stopped, or if the motor is stopped but the reversing cycle has been chosen, the mixing cycle routine continues.

The process at step 306 determines whether the hours and minutes counters of the mixing time subroutine are zero. As will be appreciated, the RAM 17 has storage locations which may be used as counters and which are used to keep track of changing time values and other changing parameters, as required. For example, the mixing cycle time set point is defined in hours and minutes. In order to keep track of the expiration of the mixing cycle time, storage locations in the RAM 17 are assigned to mixing cycle seconds and the mixing cycle hours and minutes represented by the mixing cycle set point. Further, for purposes of this disclosure, those storage locations will be referred to as counters because at predetermined times, the microprocessor is effective to incrementally change the values of those storage locations, or counters, to measure a period of time represented by the mixing cycle set point. For example, during each iteration of the mixing cycle subroutine of FIG. 3, which occurs once per second, the value of the seconds counter, or storage location in RAM 17 is decremented by one. At appropriate other times the magnitudes of the values in the minutes and hours counters are also decremented. Therefore, if, at process step 306, the mixing cycle hours and minutes counters are zero, indicating that the mixing time cycle has ended, the mixing cycle subroutine is exited. If the hours and minutes timers are still active, the process at step 308 determines whether the seconds timer is zero. If not, the process moves to step 309 at which the seconds counter is decremented by one and the mixing time subroutine is exited. During the next second, the operating system program of FIG. 2 will be executed; the mixing cycle subroutine will again be run; and process step 308 will again determine whether the seconds timer is zero. That process will iterate until process step 308 determines that the seconds counter is zero which signals the passage of one minute in the mixing cycle.

Figure 4:
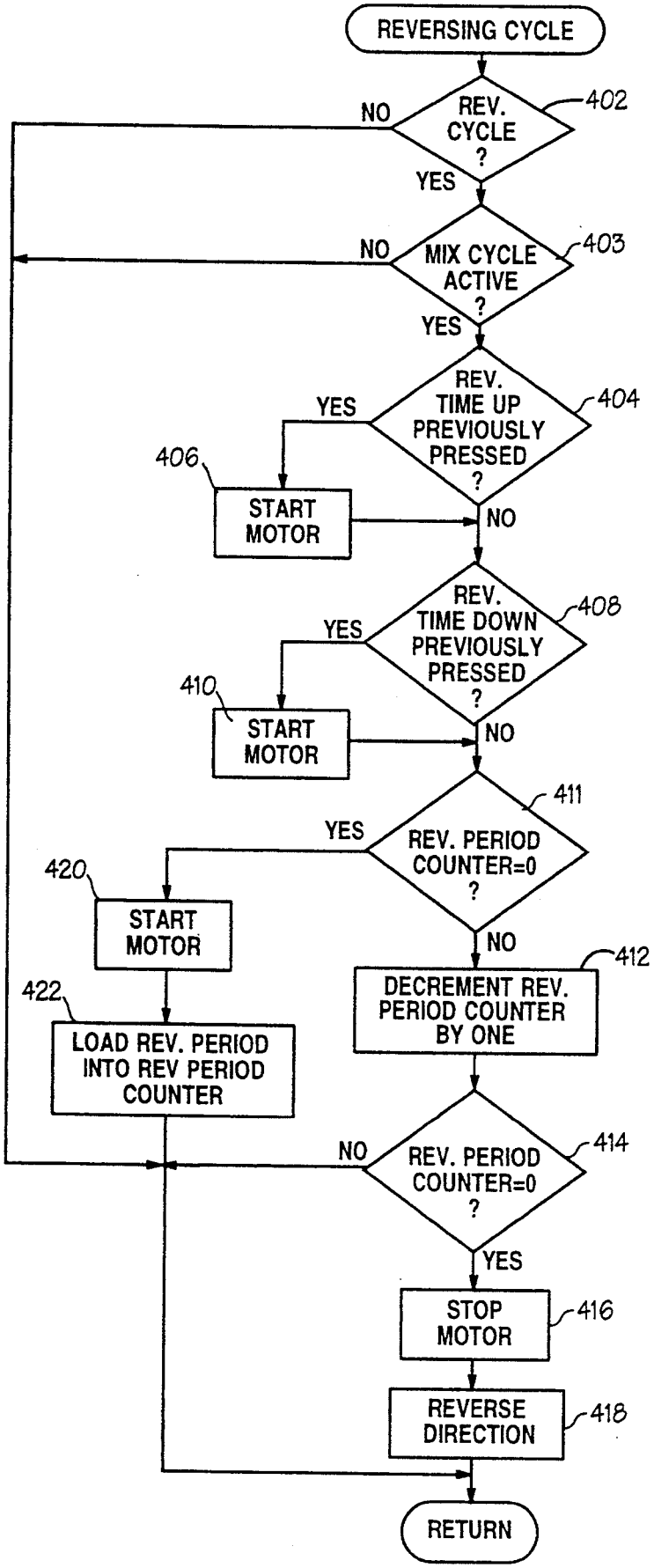
FIG. 4 is a flowchart illustrating the details of the reversing cycle subroutine by which the orbital platform mixer is controlled in a reversing cycle of operation.

After detecting that the seconds counter is zero, process at step 310 resets the seconds counter to 60, and process step 312 determines whether the minutes counter is zero. If not, at process step 314, the minutes counter is decremented by one. Alternatively, if the minutes counter has reached zero indicating the passage of one hour in the mixing cycle, the process at step 315 resets the minutes counter to sixty; and at process step 316, the hours counter is decremented by one. Next, at process step 317, a determination is made whether the hours and minutes counters are equal to zero. If not, the mixing cycle subroutine is exited. If, at process step 317, the hours and minutes counters are equal to zero, the mixing cycle is over; and at process step 318, the motor 26 is stopped. To stop the motor, the microprocessor 14 provides a signal to clear the D/A converter 18 so that the velocity output signal on line 24 is zero. Thereafter, the process at step 320 activates a mixing cycle complete indicator. For example, an audible buzzer or tone may be sounded, visual indicators may be illuminated or both of the above may be utilized to signal to the operator that the mixing cycle is complete, FIG. 4 is a flowchart illustrating the details of the reversing cycle subroutine executed at process step 227 of FIG. 2. At process step 402, the subroutine first determines whether the reversing cycle has been chosen. If not, the subroutine is exited. Otherwise, the subroutine proceeds to process step 403 which tests whether the reversing cycle is active. If not, the subroutine is exited at step 403; if so, the process continues. If the reversing cycle is active, the operating cycle routine of FIG. 2 will have produced a first direction output signal and a first velocity output signal to command operation of the motor in a first direction at a first velocity. The operator input switches are always active regardless of whether a mixing cycle is running and orbiting the platform. Therefore, the operating system must keep track of changes of states of the input switches that occur during the operation of the mixing cycle. Further, the fact that the input switches are sampled every 0.125 second; the set points are changed every 0.25 second; and the reversing cycle subroutine is executed every second means that input switch states and associated set points may change between successive executions of the reversing cycle subroutine of FIG. 3. If the reversing period set point changes after a reversing period counter goes to zero in one iteration of FIG. 3 but before the next iteration of the reversing period subroutine, the state of the reversing period counter will be set with a nonzero value. That nonzero value in the reversing period counter will interfere with the starting of the motor which would otherwise occur during the next iteration of the subroutine of FIG. 3 based on the zero state of the reversing period counter. Therefore, at process step 404, the subroutine of FIG. 3 tests whether a time-up previously pressed flag is set. The sample input switches subroutine at process step 202 of the main operating program of FIG. 2 keeps track of what switches have been depressed. If an input switch is activated by the operator, the sample input switches subroutine will set an appropriate previously pressed flag for that switch. Therefore, the process at step 404 will determine the state of the previously pressed flag for the reversing period time up input switch. If that flag is set, the process at step 406 removes the clear signal from the D/A converter 18, thereby permitting the motor to start if all other conditions are present. If, at process step 404, the previously pressed flag for the reversing period time-up switch is not set, the process continues to process step 408. Process steps 408 and 410 execute a similar process with respect to checking the state of the previously pressed flag associated with the reversing period time-down input switch.

At process step 411, the state of the reversing period counter is tested; and if the counter is not equal to zero, the counter is decremented by one count at process step 412. The process at step 414 determines whether that change in the reversing period counter state results in a zero count. If not, the reversing period subroutine is exited. The operating system routine iterates; and the reversing period counter is decremented by one with each iteration until as detected at step 231, the reversing period counter equals one. At that point, the operating routine, at process step 233 of FIG. 2, divides the computed digital motor velocity input to the D/A converter 18 in half. That results in the D/A converter 18 producing a second velocity output signal on line 24 equal to one-half its previous value. Typically, the value of the velocity output signal will be one-half of the velocity set point value. Consequently, during a predetermined time interval less than the reversing period, that is, during the last second of the reversing period, the motor 26 and orbiting platform 32 decelerate to a velocity equal to approximately one-half of the velocity set point.

During the next iteration through the operating routine of FIG. 2 and the reversing period subroutine of FIG. 4, the reversing period counter will be decremented by one at process step 412 which will result in the reversing period counter being equal to zero which is detected at process step 414. At that point, the motor is immediately stopped at process step 416 by the microprocessor 14 creating a clear signal to the D/A converter 18 which results in a zero velocity output signal on output line 24. The state of the direction signal on output line 22 is changed per step 418 thereby producing a second direction output signal commanding a direction reversal of the motor 26. Therefore, on this iteration through the reversing period subroutine the reversing period time is expired and the motor 26 and orbiting platform 32 are decelerated to a stop.

During the next iteration of the operating system routine of FIG. 2 and the reversing period subroutine of FIG. 4, one second later, the zero state of the reversing period counter is detected at step 411. The process at step 420 is effective to start the motor 26 by removing the clear signal from the D/A converter 18 thereby setting the D/A converter. Thereafter, at process step 422, the reversing period counter is reset or reloaded with the appropriate reversing period set point. As will be described, the reversing period set point may be the same for both angular directions or there may be a reversing period set point for each angular direction of rotation of the orbiting platform. Therefore, at the end of this iteration of the reversing period subroutine, the operating routine at process step 230 is effective to calculate a digital velocity signal which is input to the D/A converter 18. The D/A converter 18 produces a third velocity output signal which is effective to start the motor rotating and the platform 32 orbiting in the opposite direction. Consequently, preferably, there is approximately a one second rest period between stopping the motor and platform and restarting the motor and platform. That pause or rest period permits the inertial velocities of the mechanical components in the motor, drive and platform to dissipate before operating the system in the opposite direction. Therefore, the pause or rest period is effective to reduce wear and tear on the system components. The process of FIG. 4 is iterated until a predetermined period of time before the end of the reversing period at which time a fourth velocity output signal is produced to decelerate the velocity of the orbiting platform until the reversing period is over.

Referring to FIG. 1, in use, an operator first establishes the parameters of a desired mixing cycle. For example, the mixing cycle time would be input by using the appropriate time-up push-button 82 or time-down push-button 84. The current mixing cycle time set point is continuously displayed in the LED displays 52–60. If the time-up push-button 82 is pushed, the microprocessor 14 provides signals on a data line 86 which are serially input to the RAM 17 and stored in a mixing cycle set point store therein. In addition, the microprocessor 14 provides a time enable signal on line 88 which causes display driver 50 to display the new cycle time set point in LED displays 52–60. If the operator holds the time-up push-button 82 continuously depressed, the microprocessor 14 will continuously increase the value of the mixing cycle set point. Typically, the microprocessor scans the status of the input switches 10 every 0.125 second and produces a new cycle time set point value to the RAM 17 and display driver 50 every 0.250 seconds. In a similar manner, the operator uses the speed-up push-button 90 or the speed-down push-button 92 to set a desired velocity set point. In response to the operator depressing either the speed-up push-button 90 or speed-down push-button 92, the microprocessor will produce a new velocity set point signal on the data line 86 which is stored in a velocity set point store in the RAM 17. In addition, the microprocessor 14 will produce a speed enable signal on line 94 which will cause display driver 68 to display the velocity set point in the LED displays 62–66.

The operator uses the mode push-button 96 to determine the operating mode of the orbiting platform. Each depression of the mode push-button 96 will result in the control sequentially selecting one of the three operating modes which will be represented by the LED displays 68-72 being illuminated in response to the mode selected. As previously indicated, successive depressions of the mode push-button 96 will successively select a clockwise mixing cycle per LED display 68, a counter-clockwise mixing cycle per LED display 70 or a reversing cycle per LED display 72. The cycle start/stop push-button 46 will alternatively start and stop the mixing cycle in response to corresponding successive depressions of the push-button 46.

If the reversing cycle is chosen, the input switches 10 may be used to set the time of the reversing period. That time is set by using a combination of push-buttons. The reversing period set point is changed by holding the reversing period push-button 97 depressed and simultaneously depressing the appropriate time-up push-button 82 or time-down push-button 84 depending on whether the reversing period time is to be increased or decreased, respectively. When the reversing period push-button 97 is depressed and either of the push-buttons 82 or 84 is depressed, the microprocessor produces output signals to the display driver 50 to cause the LED displays 54–60 to display the reversing period set point in seconds. In addition, the RAM 17 stores the reversing period set point which is also stored in EEPROM 16. Preferably, the reversing period is the same for both angular directions of rotation of the orbiting platform 32.

The sample input switches subroutine 202 of the operating system routine of FIG. 2 varies the rate of change of the magnitude of the time and velocity set points in response to a continued depression of push-buttons commanding an increase or decrease of the various time and velocity parameters. While the strategy by which the rate of change of the mixing cycle set point, the reversing period set point and the velocity set point is identical, the differences in ranges of those various set points requires that the detailed implementation of that strategy be somewhat different for each set point. Therefore, a separate sample input switch subroutine is executed for each of the input switches 10 and each of the input switch combinations. Each subroutine will have the required counts and counters in the RAM 17.

Figure 5:
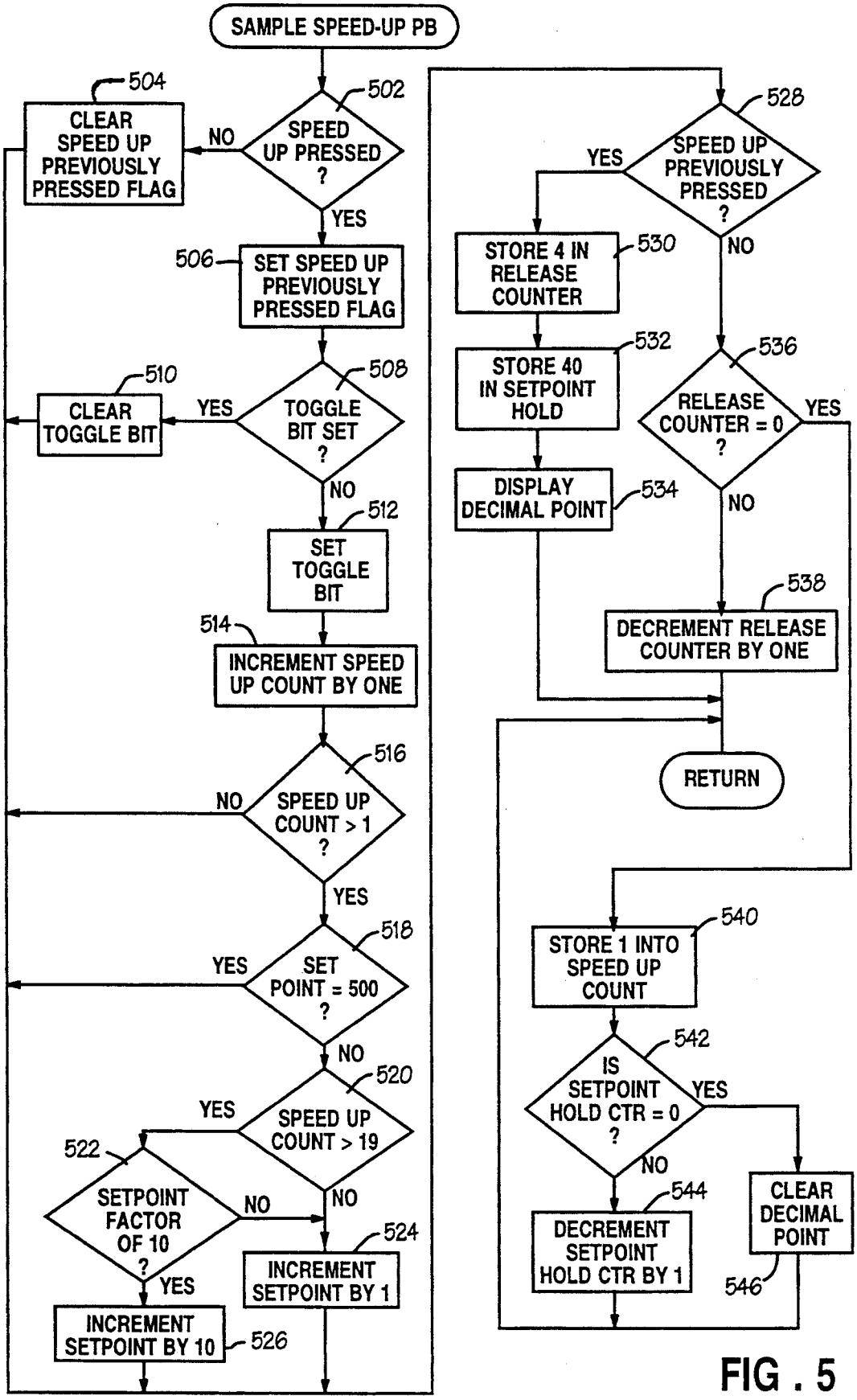
FIG. 5 is a flowchart illustrating the details of the speed-up push-button sampling subroutine by which the rate of change of the velocity set point is varied in response to a continuous depression of the speed-up push-button.

To explain the strategy, the details of the subroutine associated with the speed-up push-button 90 are shown in FIG. 5. The subroutine of FIG. 5 is executed every 0.125 second. Process step 502 detects whether the speed-up push-button is being pressed. If not, a speed-up previously pressed flag is cleared at process step 504. If the speed-up push-button is depressed, at process step 506, the speed-up previously pressed flag is set. That flag is used to keep track of the speed-up push-button being pressed from one execution of the subroutine to another. At process step 508, the microprocessor 14 checks the state of a toggle bit that is used to provide a microprocessor output or update of the velocity set point every other execution of the routine, that is, approximately every 0.25 second. Therefore, if the toggle bit is set coming into the execution of the subroutine, it is then cleared at process step 510. If the toggle bit is not set at the beginning of the execution of the subroutine, it is set at process step 512. Therefore, even though the state of the input switch is sampled every iteration of the subroutine, that is, every 0.125 second, the toggle bit regulates the processing of that information to every 0.25 second.

At process step 514, the microprocessor increments a speed-up counter by one which is a counter used to keep track of the magnitude of velocity set point change while the speed-up button is being held depressed. The process at step 516 determines whether the speed-up count is greater than one. The purpose of this test is to allow the speed-up button to be pressed once to view the set point but not change it. Next, the process at step 518 tests whether the set point is currently at 500 rpm, which is the upper limit of the velocity set point range. This test will not allow the process to increase the velocity set point over a value of 500 rpm. Process step 520 tests whether the speed-up count is greater than 19. If not, the microprocessor 14 increments the magnitude or value of the velocity set point by one 1 rpm. If the speed-up push-button remains depressed during subsequent iterations of this subroutine, the speed-up count will be incremented by one unit at process step 514 until the test at process step 520 detects a speed-up count value greater than 19. The value of the velocity set point is tested at step 522 to determine whether it is a factor of 10. If not, the velocity set point magnitude is incremented by one at process step 524. When the process at step 522 detects a velocity set point value being a factor of 10, the process at step 526 increments the magnitude of the set point by 10 increments, that is, 10 rpm. In subsequent iterations through the subroutine, if the speed-up push-button remains depressed, the process at step 526 will continue to increment the value of the velocity set point by 10 rpm.

The process at steps 520–526 illustrate the concept of the strategy by which the magnitude of the velocity set point is increased in order to move through the total velocity set point range in a shorter period of time. Essentially, in response to detecting the presence of the input signal from the speed-up push-button, the magnitude of the stored velocity set point is changed by a first incremental magnitude. Thereafter, the process detects the continuous depression of the speed-up push-button for a predetermined period of time representing a first predetermined number of the first incremental magnitudes. That period of time is arbitrary; but in the present invention, the time is defined by set point changes of 20 first incremental magnitudes, that is, at least two decades of change of the units value of velocity. In response to detecting a continuing occurrence of the input signal from the velocity speed-up push-button resulting in a continuous change of at least 20 rpm, the microprocessor 14 then initiates subsequent changes of the velocity set point by a second incremental magnitude of 10 rpm.

The strategy of process steps 520–526 may be repeated in response to a continued depression of the speed-up push-button. Therefore, when the microprocessor detects a second predetermined number of changes of the second incremental magnitude, for example, 20 increments of change of the tens value of the velocity set point, that is, a change of 200 rpm, subsequent changes will occur by third incremental magnitudes of 100 rpm. As indicated at process step 522, for ease of use, the strategy will not initiate incremental changes of 10 unless the current velocity set point equals a factor of 10. If the strategy were extended to increment 100 units with each iteration, logically that would not be initiated until the velocity set point is a factor of 100.

It should be remembered that while this subroutine is being executed, the motor 26 may be orbiting the platform 32 in response to an existing velocity set point. Further, the current angular velocity, that is, rpm of the orbiting platform is displayed in LED displays 62–66. If the speed-up push-button is depressed, the current orbiting platform rpm display in LED displays 62–66 is replaced by a display of the velocity set point value. So that the operator can readily determine whether the LED displays 62–66 are displaying the real time platform rpm or the velocity set point value, the velocity set point value is displayed with a decimal point. Further, for convenience, the subroutine of FIG. 5 provides a predetermined period of time after the velocity up push-button is released for the operator to again depress it before the subroutine recognizes the release. This features accommodates the situation where an operator may inadvertently release the speed-up push-button. Further, the routine maintains the velocity set point in the LED displays 62–66 for a period of time after the speed-up button is released.

To accommodate the above features, at process step 528, the routine determines whether the speed-up previously pressed flag is set indicating that the speed-up button is depressed. If the flag is set, the process at step 530 loads a four into a release counter which is decremented by one every 0.125 second after the speed-up push-button is released. Therefore, after the push-button is released, if the operator redepresses it within 0.5 seconds, the time it takes the release counter to go to zero, the subroutine will assume that the release of the push-button was inadvertent and ignore it. At process step 532, a value of 40 is loaded into a set point hold counter which controls the amount of time the velocity set point is displayed after the speed-up push-button is released. Since that counter is clocked every 0.125 second, the velocity set point value will be displayed five seconds after the speed-up button is released. The process at step 534 initiates the display of the decimal point in association with the LED displays 62–66 thereby indicating the current display is the velocity set point.

If, at process step 528, the speed-up previously pressed flag is not set indicating that the speed-up push-button is not pressed or, is released, the process at step 536 tests whether the release counter is zero. If not, the release counter is decremented by one count at process step 538. As long as the speed-up push-button remains released, during successive iterations every 0.125 second, the remainder of the process is bypassed by the operation at process steps 502, 504. Therefore, the values of the speed-up count and the speed-up set point do not change, and the release counter will be decremented by one every such iteration. If the operator redepresses the push-button in less than 0.5 seconds, the time it takes the release counter to go to zero, the subroutine at steps 506–528 will resume its execution with values of the speed-up count and speed-up set point that existed when the push-button was first released. Therefore, the rate at which the set point is being changed will not change due to a short release of the push-button.

If the operator does not redepress the push-button within 0.5 seconds, the release counter will count to zero; and at process step 540, the speed-up count is set to one. If the speed-up button is again pressed, during the next iteration of the subroutine, the speed-up previously pressed flag is set; and at step 514, the speed-up count is incremented by one. At step 516, the speed-up count is tested to determine whether it is greater than one; and the process continues as previously described. Changes to the set point will be at the lowest incremental level. At process step 542, the set point hold counter is tested for zero value. If the value is not zero, the set point hold counter is decremented by one at process step 544. During subsequent iterations of the routine during which the speed-up push-button is released, the set point hold counter will count to zero after five seconds. That will be detected at process step 542, and at process step 546, the decimal point display is cleared; and the microprocessor changes the data displayed LED displays 62–66 from the velocity set point to the current rpm of the motor.

Preferably, the scanning routine for the time-up push-button 82 has a similar strategy in that after a time-up count reaches 19 and the mixing cycle time set point is a factor of ten, the mixing cycle set point is incremented by ten minutes with each iteration through the routine. As long as the time-up push-button remains depressed, the speed-up counter continues to increment while the velocity set point value is changing by increments of ten minutes. The subroutine continues increasing in increments of ten minutes until the velocity set point increases through three hours. The value of the speed-up counter corresponding to that number of changes can then be used to switch the incremental increase of the set point value to whole integers of hours. Therefore, with each iteration through the sample time-up push-button subroutine, the mixing cycle time set point value increases in one hour increments. Again, with a continued depression of the time-up push-button, the point at which the mixing time set point passes twenty hours can be detected and used to initiate subsequent changes of the mixing cycle set point in increments of tens of hours. The sample input switch routine for the time-down push-button would operate in a similar manner.

While the invention has been set forth by the description of the embodiment in considerable detail, it is not intended to restrict or in any way limit the claims to such detail. Additional advantages and modifications will readily appear to those who are skilled in the art. For example, the motor 26 may be an electric, pneumatic or other rotary power device. The motor 26 may also be a linear actuator such as a pneumatic piston and cylinder that is connected through a rack and pinion to the orbital drive 30. Alternatively, the orbital drive 30 may be designed to accept the output of the pneumatic piston and cylinder. Or, the orbital drive may be designed to create a reversing motion in response to a continuous unidirectional rotation of a motor. The invention is applicable to any motorized bidirectional drive which provides a reversing orbital motion of the platform.

The control 8 is comprised of the input circuit 9, the signal processing circuit 12, the display circuit 20 and the analog controller 28. The signal processing circuit 12 is comprised of microprocessor 24 part no. MC68HC711D3CFN2, commercially available from Motorola of Oak Hill, Tex., D-A converter 18, preferably part no. AD7243AN, commercially available from Analog Devices of Norwood, Mass., and EEPROM 16, preferably part no. X24C45P, commercially available from Xicor of Milpitas, Calif. The display circuit 20 is made up of display drivers part no. MC14489P, commercially available from Motorola, of Austin, Tex. The analog controller is preferably part no. PC734X2, commercially available from Barnstead Thermolyne of Dubuque, Iowa, and the brushless DC motor is preferably part no. 71004-0246, commercially available from Fasco, of Ozark, Miss. The above devices may be implemented with other components providing the same or similar function. Various timing periods such as the release counter timing period and the set point hold counter timing period may be varied for different applications. The reversing period push-button may be eliminated, and the reversing period set point changed by pushing the mode switch 96 in combination with the time-up and time-down push-buttons 82, 84.

The error correction determined at process step 228 may or may not be used depending on the operating mode selected. For example, if the reversing cycle is chosen with a very short reversing period, for example, five seconds, the four second delay before providing the error correction will not provide beneficial results. Therefore, the error correction process step may be bypassed if the reversing cycle mode is selected. Alternatively, the error correction process step may be bypassed if the reversing cycle mode is selected and the reversing period is less than some minimum time, for example, 30 seconds.

In the reversing cycle, a different reversing period may be set for each direction of rotation. The reversing period push-button may be used to set a first reversing period set point for one direction of rotation, for example, a clockwise direction and a second reversing period set point for the opposite counterclockwise rotation of the orbiting platform 32. The value of those set points may be selected from 5 seconds to 9999 seconds, and the first and second reversing period set points are stored by the microprocessor 14 in the RAM 17 and may also be stored in the RAM 17 and EEPROM 16. The two set points are selected by using the reversing period push-button 97 to select the clockwise and counterclockwise directions with successive depressions of the push-button 97. The selected direction is displayed by the appropriate one of the LED displays 68 and 70 in addition to the LED display 72 indicating that the reversing cycle has been chosen. The time-up and time-down push-buttons 82, 84 are then used to establish the selected reversing period set point. The appropriate first or second reversing period set point is then utilized at process step 422 of FIG. 4.

In a similar manner, the reversing period push-button 97 may be used in conjunction with the speed-up and speed-down push-buttons 90, 92 to provide input signals from which the microprocessor 14 can determine and store in the RAM 17 and the EEPROM 16, first and second velocity set points representing first and second desired angular velocities of the platform associated with rotation of the platform in the respective first and second angular directions.

Instead of the fixed one second pause, the control 8 may be configured so that the operator may use the input circuits 9 to selectively provide input signals from which the microprocessor 14 can determine and store a pause set point. For example, the pause period of time may be changed by depressing the mode push-button 96 and simultaneously depressing either the time-up push-button 82 or the time-down push-button 84. A pause period set point would be stored by the microprocessor 14 in an appropriate storage location in the RAM 17. Preferably, the pause period of time and the pause set point is measured in one second increments. Therefore, after the zero state of the reversing period counter is detected at step 411, a pause counter may be used to count a selectable number of seconds prior to starting the motor in the opposite direction. The test for the pause counter being zero and the decrementing of the pause counter can be made after process step 403 tests for an active reversing cycle of operation.

The invention in its broadest aspects is therefore not limited to the specific details shown and described. Accordingly, departures may be made from such details without departing from the spirit or scope of the general inventive concept.

What is claimed is:

1. An orbiting platform mixer comprising:

a bidirectional drive;

a platform mechanically coupled to said bidirectional drive to cause an orbiting motion of said platform in a first angular direction in response to operation of said bidirectional drive in one direction and an orbiting motion of said platform in a second angular direction in response to operation of said bidirectional drive in an opposite direction; and a control connected to said bidirectional drive for commanding a reversing orbiting cycle of operation of said bidirectional drive, said control comprising input circuits for providing input signals to establish a mixing cycle set point representing a desired time period for a mixing cycle; and a signal processing circuit connected to said input circuits for automatically producing output signals to said bidirectional drive to command a reversing cycle of operation of said platform, said output signals sequentially:

operating said bidirectional drive in said one direction for a first predetermined period of time to orbit said platform in said first angular direction, stopping after said first predetermined period of time said bidirectional drive for a predetermined pause period of time, operating after said predetermined pause period of time said bidirectional drive in said opposite direction for a second predetermined period of time to orbit said platform in said second angular direction, and stopping said bidirectional drive for the predetermined pause period of time, said signal processing circuit iteratively producing said output signals to repeat said reversing cycle of operation of said orbiting platform for a period of time represented by said mixing cycle set point.

2. The orbiting platform mixer of claim 1 wherein said input circuits further provide input signals to establish a reversing period set point representing a reversing period of the orbiting motion of said platform in an angular direction and said control produces output signals to operate said bidirectional drive in said one direction for a period of time represented by said reversing period set point.

3. The apparatus of claim 2 wherein said control further produces output signals for decelerating said bidirectional drive prior to an end of said period of time represented by said reversing period set point.

4. The orbiting platform mixer of claim 1 wherein said bidirectional drive includes a motor and said control further includes a motor control circuit connected between said signal processing circuit and said motor for operating said motor in response to said output signals produced by said signal processing circuit.

5. The apparatus of claim 4 wherein said output signals produced by said signal processing circuit further comprise:

a first direction output signal representing operation of said motor in said one direction;

a first velocity output signal for commanding operation of said motor in said one direction to orbit said platform in said first angular direction at a first angular velocity;

a second velocity output signal in response to a predetermined time interval less than said reversing period for commanding operation of said motor in said one direction to orbit said platform in said first angular direction at a second angular velocity less than said first angular velocity;

a second output direction signal representing operation of said motor in said opposite direction;

a third velocity output signal for commanding operation of said motor in said opposite direction to orbit said platform in said second angular direction at a third angular velocity; and a fourth velocity output signal in response to a predetermined time interval less than said reversing period for commanding operation of said motor in said opposite direction to orbit the platform in said second angular direction at a fourth angular velocity less than said third angular velocity.

6. The apparatus of claim 5 wherein said control initiates a first reversing period of said reversing cycle of operation by producing said first direction output signal and said first velocity output signal, and said control terminates said first reversing period by terminating said second velocity output signal after an expiration of a period of time represented by said reversing period set point.

7. The apparatus of claim 6 wherein said control initiates a second reversing period by producing said second direction output signal and said third velocity output signal in response to the expiration of a predetermined pause period of time, and said control terminates said second reversing period by terminating said fourth velocity output signal after an expiration of a period of time represented by said reversing period set point.

8. The apparatus of claim 7 wherein said control further comprises input circuits for providing a pause set point signal representing said predetermined pause period of time.

9. The apparatus of claim 8 wherein said control further comprises input circuits for providing first and second reversing period set point signals representing first and second reversing periods of orbiting motion of said platform in said first and second angular directions, respectively, and said control terminates said second velocity signal in response to an expiration of a period of time represented by said first reversing period set point and said control terminates said fourth velocity command signal in response to a period of time represented said second reversing period set point.

10. The apparatus of claim 9 wherein said control further comprises input circuits for providing a first velocity set point representing a desired angular velocity of said platform, and said control produces said first and third velocity output signals in response to said first velocity set point and said first and third angular velocities are equal to said desired angular velocity of said platform.

11. The apparatus of claim 5 wherein said predetermined time interval less than said reversing period is equal to approximately one second.

12. The apparatus of claim 5 wherein said second and fourth angular velocities are equal to one-half said first and third angular velocities, respectively.

13. The apparatus of claim 1 wherein said control further comprises input circuits for providing a first and second velocity set point signals representing first and second desired angular velocities of said platform, and said control produces said first and third velocity output signals in response to said first and second velocity set point signals, respectively, and said first and second angular velocities are equal to said first and second desired angular velocities, respectively, of said platform.

14. The apparatus of claim 1 wherein said control further comprises input circuits for producing a cycle start signal and said control initiates a reversing cycle of operation in response to said start signal.

15. The apparatus of claim 1 wherein said signals generated by said input circuit are digital signals and said signal processing circuit is a microprocessor circuit.

16. The orbiting platform mixer of claim 1 wherein said input circuits further comprise an input switch producing a single input signal in response to a state of said input switch and said signal processing circuit changing a magnitude of said mixing cycle setpoint in response to the said single input signal by detecting a first occurrence of the single input signal;

changing the magnitude of the set point value by a first incremental magnitude in response to detecting said first occurrence of the single input signal;

detecting a continuing occurrence of the single input signal;

changing the magnitude of the set point value by successively greater incremental magnitudes in response to detecting a continuing occurrence of the single input signal;

detecting an absence of the single input signal;

interrupting the steps of changing the magnitude of the set point value in response to detecting the absence of the single input signal;

detecting the reoccurrence of the single input signal within a predetermined period of time after detecting the absence of the single input signal;

resuming the step of changing the magnitude of the set point value by successively greater incremental magnitudes in response to detecting the reoccurrence of the of the single input signal.

17. The orbiting platform mixer of claim 16 wherein said signal processing circuit further resumes the step of changing the magnitude of the set point value by said first incremental magnitude in response to detecting the reoccurrence of the single input signal after said predetermined period of time.

18. The orbiting platform mixer of claim 17 wherein said predetermined period of time is 0.5 seconds.

19. A method of automatically operating an orbiting platform mixer having a platform mechanically coupled to a bidirectional drive responsive to output signals produced by a control, said control producing the output signals to the bidirectional drive to execute a mixing cycle comprising the steps of:

orbiting the platform in a first angular direction at a first angular velocity for a first reversing period;

stopping the platform after said first reversing period for a predetermined pause period of time;

orbiting the platform after said predetermined pause period of time in an opposite angular direction at a second angular velocity for a second reversing period;

stopping the platform after said second reversing period for said predetermined pause period of time; and iterating the steps of orbiting the platform in a first angular direction, stopping the platform for the pause period of time, orbiting the platform in the opposite angular direction and stopping the platform for the pause period of time for a period of time defining the mixing cycle.

20. The method of claim 19 wherein said method further comprises the step of determining a velocity set point, said velocity set point representing said first and second angular velocities.

21. The method of claim 19 wherein said method further comprises the steps of determining a first velocity set point representing said first angular velocity and a second velocity set point representing said second angular velocity.

22. The method of claim 19 wherein said method further comprises the step of determining a reversing period set point representing said first and second reversing periods.

23. The method of claim 19 wherein said method further comprises the steps of determining a first reversing period set point representing said first reversing period and a second reversing period set point representing said second reversing period.

24. The method of claim 19 wherein the method further comprises the step of producing a mixing cycle set point representing said period of time defining the mixing cycle.

25. A method of claim 19 wherein said reversing cycle further comprises the steps of:

orbiting the platform in said first angular direction at a third angular velocity less than said first angular velocity and for a time interval less than said first reversing period to decelerate the orbiting platform from said first angular velocity to said third angular velocity; and orbiting the platform in said opposite angular direction at a fourth angular velocity less than said second angular velocity for a second time interval less than said second reversing period to decelerate said orbiting platform from said second angular velocity to said fourth angular velocity.

26. The method of claim 19 wherein the control produces output signals to the bidirectional drive in response to mixing cycle set points, and the control changes the mixing cycle set points in response to an input switch producing a single input signal in response to a state the input switch, and wherein the method further comprises the steps of:

detecting a first occurrence of the single input signal;

changing the magnitude of the set point value by a first incremental magnitude in response to detecting said first occurrence of the single input signal;

detecting a continuing occurrence of the single input signal;

changing the magnitude of the set point value by successively greater incremental magnitudes in response to detecting a continuing occurrence of the single input signal;

detecting an absence of the single input signal;

interrupting the step of changing the magnitude of the set point value in response to detecting the absence of the single input signal;

detecting the reoccurrence of the single input signal within a predetermined period of time after detecting the absence of the single input signal;

resuming the step of changing the magnitude of the set point value by successively greater incremental magnitudes in response to detecting the reoccurrence of the of the single input signal.

27. The method of claim 26 wherein the method further comprises the step of resuming the step of changing the magnitude of the set point value by said first incremental magnitude in response to detecting the reoccurrence of the single input signal after said predetermined period of time.

28. The method of claim 27 wherein said predetermined period of time is 0.5 seconds.

29. The method of claim 19 wherein the method further comprises the step of producing a mixing cycle set point representing said pause period of time.

* * * * *